US006076434A

United States Patent [19]

Boukis

[11] Patent Number: 6,076,434

[45] Date of Patent: Jun. 20, 2000

[54] INDIVIDUALLY ADJUSTABLE DOUBLE ENDED WRENCH

[76] Inventor: John Boukis, 6205 Beverly Dr., Parma Heights, Ohio 44130

[21] Appl. No.: 08/921,841

[22] Filed: Sep. 2, 1997

Related U.S. Application Data

[63] Continuation-in-part of application No. 08/669,108, Jun. 24, 1996, abandoned.

[51] Int. Cl.[7] ..... B25B 13/16

[52] U.S. Cl. ..... 81/165; 81/172; 81/171

[58] Field of Search ..... 81/129.5, 165, 81/172, DIG. 2, DIG. 4, 129, 170, 171, 77, 55

[56] References Cited

U.S. PATENT DOCUMENTS

| | | | |
|---|---|---|---|
| 73,561 | 1/1868 | Wrightson | 81/129.5 |
| 389,400 | 9/1888 | Mead | 81/171 |
| 465,560 | 12/1891 | Hill . | |
| 620,738 | 3/1899 | Chisholm | 81/172 |
| 677,529 | 7/1901 | Miller . | |
| 703,898 | 7/1902 | Davison . | |
| 854,338 | 5/1907 | Deeves . | |
| 854,376 | 5/1907 | McArthur . | |
| 979,348 | 12/1910 | Smith . | |
| 1,158,913 | 11/1915 | Fleck . | |
| 1,321,236 | 11/1919 | McCraith . | |
| 1,391,179 | 9/1921 | Evans et al. . | |
| 2,753,748 | 7/1956 | Schlote . | |
| 2,982,161 | 1/1961 | Angguist . | |
| 3,363,490 | 1/1968 | Maichen . | |
| 3,541,899 | 11/1970 | Tanner . | |
| 3,555,939 | 1/1971 | Halls . | |
| 3,640,159 | 2/1972 | Halls . | |
| 3,673,896 | 7/1972 | Vardaman . | |
| 4,046,034 | 9/1977 | Flewelling . | |
| 4,108,027 | 8/1978 | Lenker . | |
| 4,311,070 | 1/1982 | Whiteford . | |
| 4,967,613 | 11/1990 | Cone . | |
| 5,305,667 | 4/1994 | Caballero . | |
| 5,415,064 | 5/1995 | Chang . | |

FOREIGN PATENT DOCUMENTS

| | | |
|---|---|---|
| 895662 | 1/1945 | France . |
| 1810065 | 11/1967 | Germany . |

*Primary Examiner*—David A. Scherbel
*Assistant Examiner*—Joni B. Danganan
*Attorney, Agent, or Firm*—Joseph H. Taddeo

[57] ABSTRACT

An adjustable jaw double ended wrench, where each set of jaws is gear operated. Each end wrench is adjustable, both individually and independently; the open end wrench driven by a spiral grooved shaft with beveled gears; the closed end wrench, linearly actuated by a direct driven spiral grooved shaft. At one end of the wrench is an adjustable open end wrench with a set of parallel jaws, useful in tightening or removing hex fasteners, such as hex and machine screw nuts, and cap screws. The other end, an adjustable closed end wrench for tightening or removing hex head cap screws, hex-head nuts, as well as for clutching other work. This wrench end is particularly well suited for use in areas that are blind to the user, especially in such applications as in automotive assembly and repair, ship inboard motor repair and numerous other applications of assembly and disassembly of items that may not be within the view of the user.

18 Claims, 6 Drawing Sheets

INDIVIDUALLY ADJUSTABLE DOUBLE ENDED WRENCH

REFERENCE TO PREVIOUSLY FILED APPLICATIONS

This application is a continuation-in-part of the prior Patent Application of John Boukis, identified by Ser. No. 08/669,108, filed Jun. 24, 1996, now abandoned. Benefit of the filing date for original disclosure material in the parent domestic application is claimed under 35 USC 120 and 37 CFR §1.53.

FIELD OF INVENTION

This invention relates to a gear operated wrench, and more particularly to a double ended wrench, where each end is adjustable, both individually and independently. One end is comprised of an adjustable open end wrench with a set of parallel jaws, useful in tightening or removing hex fasteners, such as hex and machine screw nuts, and cap screws. The other end, an adjustable closed end wrench for tightening or removing hex head cap screws, hex-head nuts, as well as for clutching other work. This wrench end is particularly well suited for use in areas that are blind to the user, especially in such applications as in automotive assembly and repair, ship inboard motor repair and numerous other applications of assembly and disassembly of items that may not be within the view of the user.

BACKGROUND OF THE INVENTION

From the dawn of civilization, early man used primitively designed tools, made from rocks and tree limbs, to assist him in making his work easier. Later developed tools were made from various metals, which were more durable and longer lasting. It was not until the turn of the century where the advent of the automobile created a need for specialized tools, such as wrenches, used for constructing and maintaining these vehicles. Wrenches are latecomers into the tool world, not needed until threaded nuts and bolts were made. Thus a need for specialized tools was created, as the density and complexity of the automobile motor compartments became more dense, obscuring many components from view and reach of the repair mechanic. This invention fulfills a partial need for one of these specialized tools.

There are numerous patents that relate to single ended, adjustable open end wrenches, whose moveable jaws are driven by the well-known slide driven helical gear to actuate a moveable jaw. These early designs are characterized by the following U.S. Patents.

U.S. Pat. No. 4,046,034, granted Sep. 6, 1977, to H. J. Flewelling, discloses improvements in construction of an open end adjustable wrench of the type that utilizes a handle enclosed helix-actuating assembly and thumb slide actual-or for opening and closing the jaws of a wrench.

U.S. Pat. No. 3,673,896, granted Jul. 4, 1972, to H. W. Vardaman, discloses a spiral actuated, adjustable jaw end wrench, in which an adjustable jaw is operated by a worm gear, where the worm gear is operated by a spiral groove drive. The spiral groove drive being operated by a circular cam riding in the spiral groove drive.

U.S. Pat. No. 3,640,159, granted Feb. 8, 1972, to K. F. Halls, et al, teaches an adjustable jaw wrench, where the moveable member carrying the jaw toward and away from the fixed jaw is reciprocated by means of a worm in a well-known manner.

U.S. Pat. No. 3,555,939, granted Jan. 19, 1971, to K. F. Halls, discloses an adjustable open end wrench that has a slidable jaw that is manipulated by a finger driven actuating member.

U.S. Pat. No. 3,541,899, granted Nov. 24, 1970, to J. H. Tanner, discloses a quickly adjustable end wrench, where the adjustment of the moveable wrench jaw is effected by means of a slide moveable along the handle to rotate a helical geared shaft that is gear connected to a worm which in turn actuates the jaw.

U.S. Pat. No. 3,125,911, granted Mar. 24, 1964, to G. F. Scholte, teaches an improved construction of a slidable jaw end wrench with a spiral actuator that has an improved means of connecting the spiral actuator to a drive means to materially facilitate the assembly of the wrench parts.

U.S. Pat. No. 2,753,748, granted Jul. 10, 1956, to G. F. Scholte, discloses an improved construction of an actuating means for a spiral actuator of a sliding jaw wrench.

Many of the above referenced prior art disclose previously designed wrenches that are single ended where the user must perform several redundant operations in handling these tools.

There are many problems that exist in using the various wrenches described. One may find it necessary to set the wrench down and exchange it for one of a different size or shape; especially where a tool that has a plurality of adjustable wrench ends would be more suitable.

What is needed is a multi-functionally designed wrench that has a plurality of work engaging means that are independently adjustable. In this regard, this invention fulfills this need.

SUMMARY OF THE INVENTION

The present invention finds particular application in industry and in the home, especially when one is working in tight cramped quarters. When one uses a single- ended wrench, there may be an occasion when one may have to change to another wrench size or shape. Using two wrenches to do the job where one can serve the purpose is more costly when purchased; and when being used, takes more time to select and find a different sized wrench.

This newly designed wrench obviates the need for using a multiplicity of various sized wrenches by providing an adjustable double-ended wrench, where one end is open ended; the other, closed.

In the preferred embodiment, the open end wrench has an adjustable jaw that can be positioned parallel to the fixed opposing jaw. One adjusts the jaw opening by moving the slide button in the handle either forward or rearward. The slide button engages a helical groove in an elongated screw shaft. At one end of the elongated screw shaft is a beveled drive pinion. The driven pinion drives a mating beveled pinion that rotates an actuating screw. Rotation of the actuating screw causes the threaded lower jaw to advance upwardly or downwardly.

At the end opposite to the open end wrench is an independently adjustable closed end wrench. A fixed jaw is found at the extreme end of the wrench. The inner jaw is moveable by moving the slide button forward or rearward. This independent slide button has a protruding boss that engages a helical groove in another elongated shaft. At a forward end of the elongated shaft is a connected drive gear, that engages a worm drive gear for rotating a worm pinion that drives an associated rack interconnected with the movable jaw through a load bearing, such that linear action on the slide button causes that jaw to move in a closing or opening direction.

It is an object of this invention to provide for a double ended wrench that finds usefulness when working in cramped, closed spaces.

It is another object of this invention to provide for a double ended wrench where each wrench end is adjustable.

It is still another object of this invention to provide for an adjustable double ended wrench where each wrench end is independently adjustable from each other.

Yet it is another object of this invention to provide for an independently adjustable double ended wrench where one wrench end is an open end wrench; the opposite wrench end being a closed end wrench.

Lastly, it is another object of this invention to provide for an independently adjustable double ended wrench, where the closed end wrench is linearly actuated through a slide driven helical geared shaft.

BRIEF DESCRIPTION OF THE DRAWINGS

The invention is diagrammatically illustrated in the following drawings attached herein.

DESCRIPTION OF THE PREFERRED EMBODIMENTS

Figure 1A:
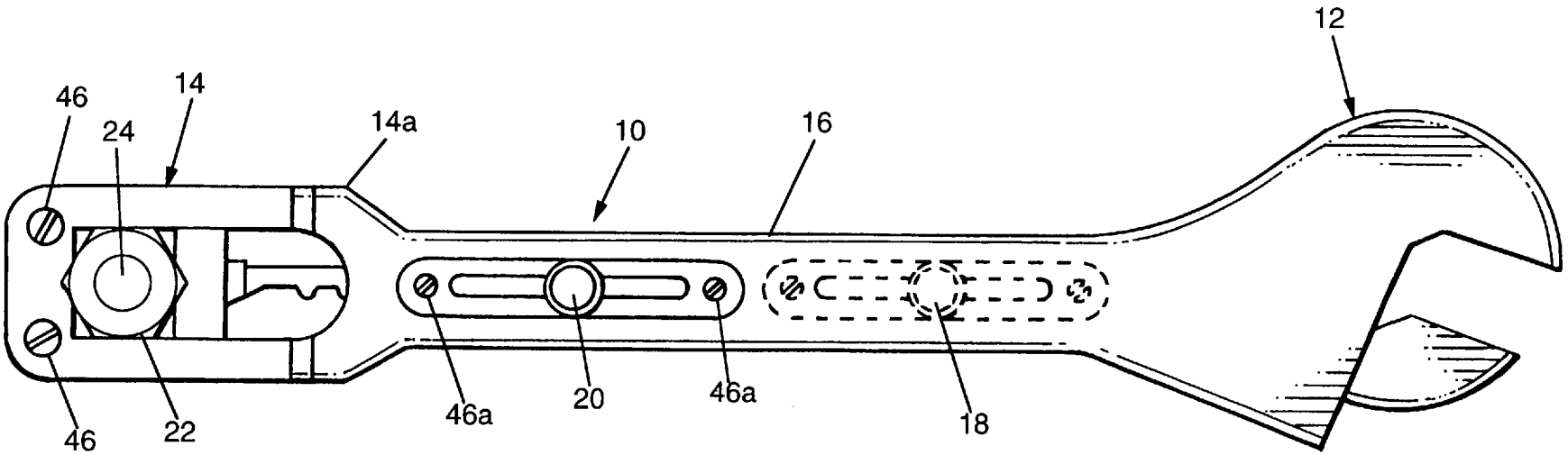
FIG. 1*a* is side elevation view of the double ended wrench. At one end of the preferred embodiment is a slide adjustable open end wrench; at the opposite end, a slide adjustable closed end wrench.
Figure 1B:
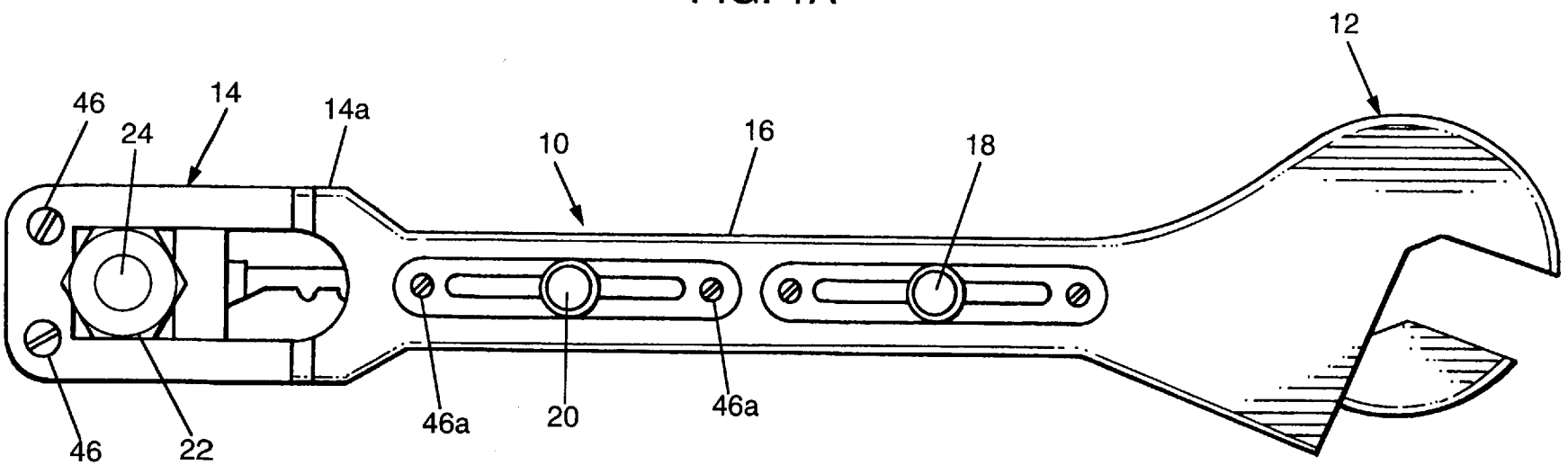
FIG. 1*b* is a side elevation of an alternative embodiment of the double ended wrench with the first and second slide buttons positioned on the same side of the wrench.

Referring first to FIG. 1*a* of the drawings, the double ended wrench is designated 10 that includes a canted open end wrench head 12, closed end wrench head 14, wrench body 14*a,* and an elongated handle 16. Located on either side of the elongated handle 16 are two independently actuated slide buttons 18,20 that provide a means of rotating the individual helical geared shafts 36,70*a*. In the alternative, the slide buttons 18,20 may be positioned on the same side of the handle 16. (FIG. 1*b*) When open ended wrench 12 is in use, slide button 18 provides a means of rotating its respective helical geared shaft. When gripping the handle 16 to use the wrench 12, slide button 18 is operated by a rectilinear motion along the handle 16 by the thumb. Forward movement of slide button 18 closes the jaw opening, whereas a rearward movement of slide button 18 opens the jaw opening.

Conversely, when the closed ended wrench 14 is in use, slide button 20 provides a means of rotating its respective helical geared shaft. When gripping the handle 16 to use the wrench 14, slide button 20 is operated by a rectilinear motion along the handle 16 by ones thumb. Forward movement of slide button 20 closes the jaw opening, whereas a rearward movement of slide button 20 opens the jaw opening.

Figure 6:
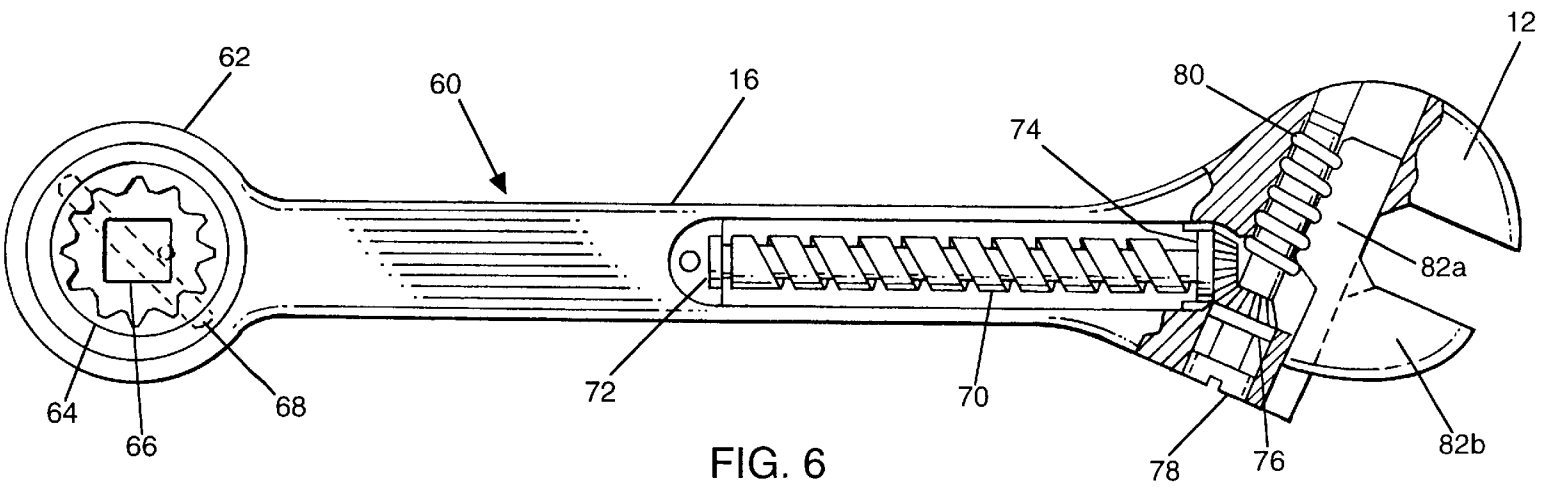
FIG. 6 is a side elevational view of an another alternative embodiment of the double ended wrench. Shown at one end is a ratcheted bi-directional socket wrench that accepts interchangeable sockets. Shown at the opposite end is an adjustable open end wrench. Detailed is a typical slide actuated helical geared shaft, acting upon a set of beveled gears that operate the lower jaw.

FIG. 6 illustrates the detailed construction of a typical slide driven adjustable open end wrench 12. The wrench 12 is canted, whereby its jaws and consequently the opening or socket thereby defined are at an angle from the wrench handle 16. They are not linear. The slide button 18 engages the spiral grooved shaft 70. Identical end bearings 72 maintain the relative position of the spiral groove shaft 70. Rigidly attached to one end of the spiral grooved shaft 70 is beveled pinion 74, which in turn mates with beveled pinion 76. The worm gear assembly includes the beveled pinion gear 76 rigidly attached to worm gear 80. The worm gear assembly is held in place by annular nut 78. Rack 82*a* engages worm gear 80 that opens and closes the lower jaw 82*b*.

In typical operation, the slide button 18 provides a means of rotating the helical shaft 70 by the rectilinear motion of the slide button along the longitudinal direction of the elongated handle 16. The rotation of the helical grooved shaft 70, rotates beveled gear 74, beveled pinion gear 76, and subsequently worm gear 80. Thus the lower jaw 82*b* moves in accordance with rack 82*a* that is positioned by the rotation of worm 80.

Figure 2:
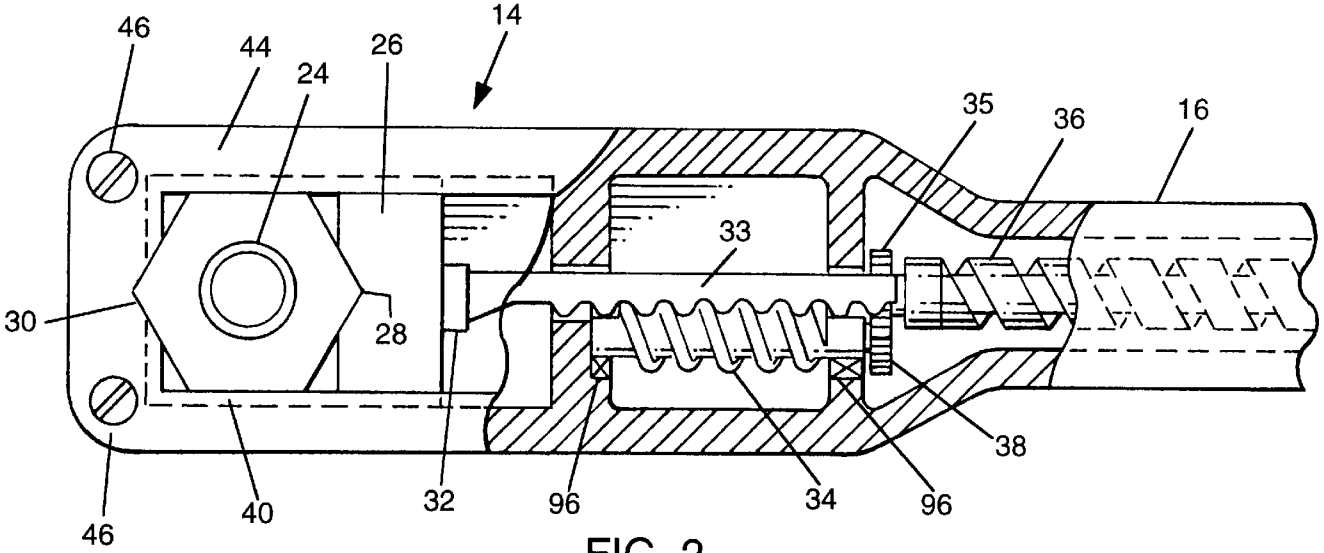
FIG. 2 is a partly cutaway top elevation view of the adjustable closed end wrench showing a hex-head cap screw captivated by the jaws of the wrench.
Figure 3A:
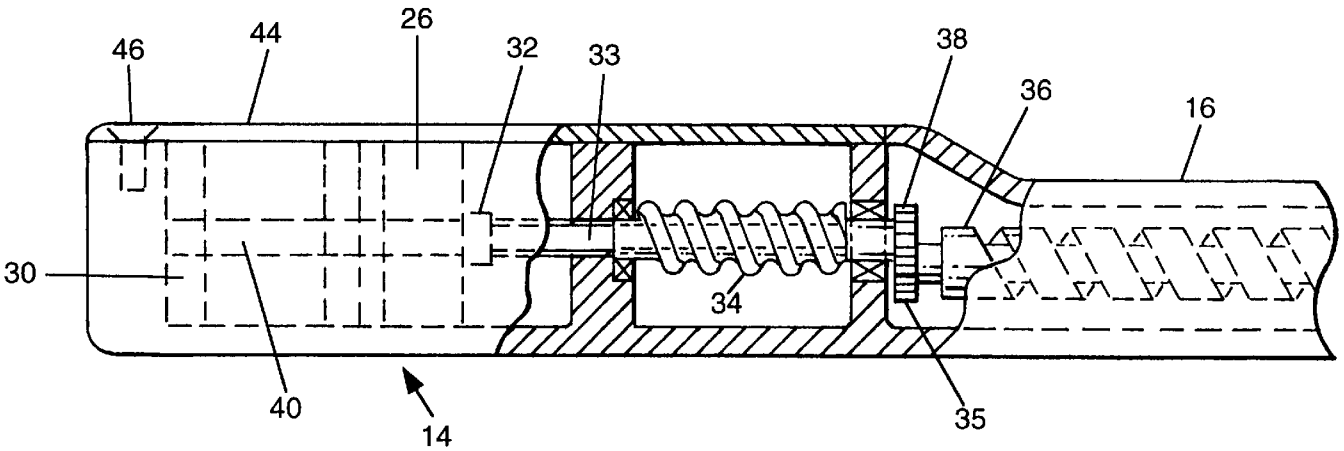
FIG. 3*a* is a partly cutaway side elevation of the adjustable closed end of the double ended wrench.
Figure 4:
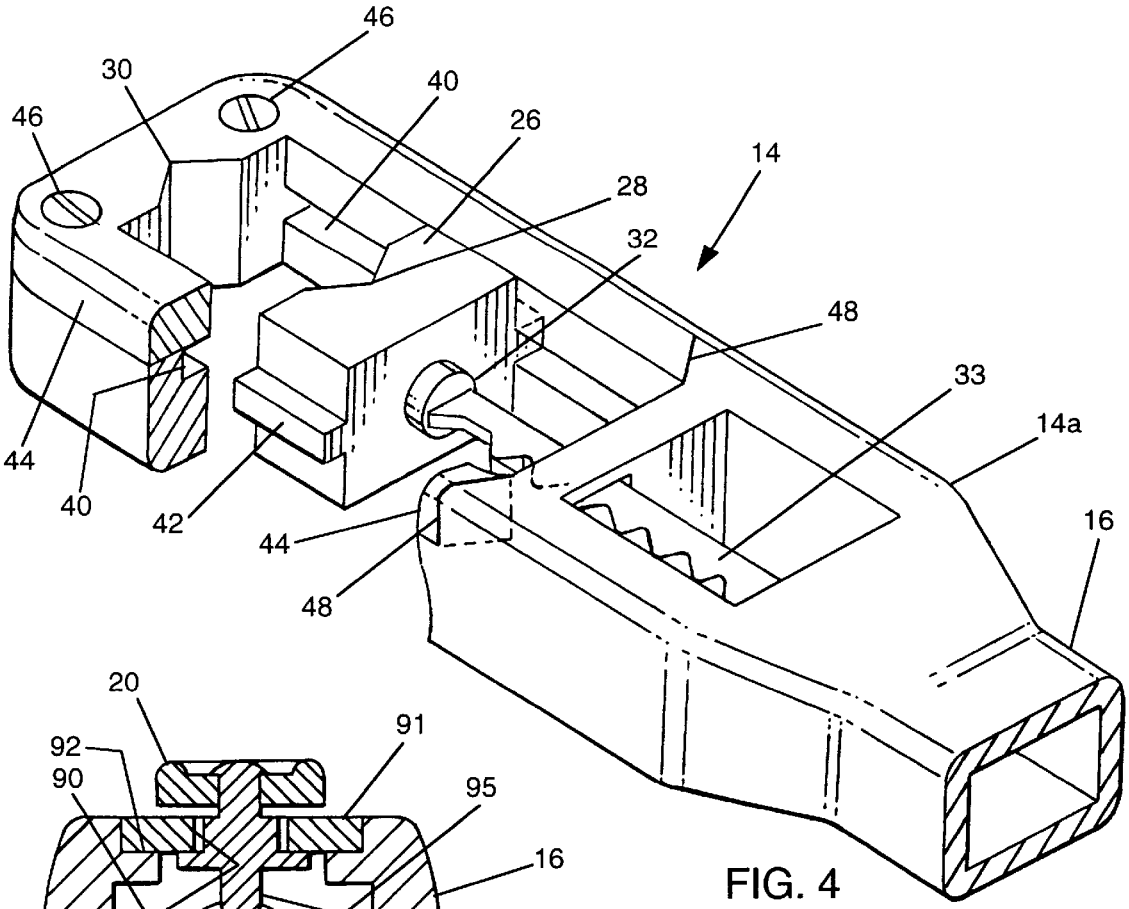
FIG. 4 is a partly cutaway perspective view of the adjustable closed end wrench showing the detailed construction of the closed end of the double ended wrench.

FIGS. 2 and 3*a* show the detailed top and side elevational views and FIG. 4 shows a perspective view of the closed end wrench 14. This is a linear wrench that finds particular use in gripping hex-nuts and hex-head cap screws, as shown as hex-head cap screw 24 and in FIG. 1*a,* as hex-nut 22. Moveable jaw 26 clamps various sized hex shaped hardware, ranging from No. 6 to 1 inch hex-nuts. The fixed jaw 30 and the moveable jaw 26, that define a clamping area 28 therebetween, are both shaped to 120 degrees, so that they can receive and be fully clamped against the six side s of a hex shaped workpiece, thereby reducing the potential for stripping a hex nut.

Referring now particularly to FIGS. 2, 3*a* and 4, a captive compression bearing 32 retains the moveable rack gear or rack 33 to allow full travel motion to the moveable jaw 26. The helical geared shaft 36 is rigidly connected to the helical shaft drive gear 35, that by its rotation drives worm drive gear 38. The moveable rack gear 33 engages worm gear or pinion 34 of the elongated handle 16. Attached to one end of the captivated worm gear 34 is worm drive gear 38. Worm drive gear 38 is in engagement with, and driven by, the rotation of helical drive gear 35. Rotating the helical grooved shaft 36 results in the opening or closing of the hex jaws 28, depending upon the direction of rotation.

Figure 3B:
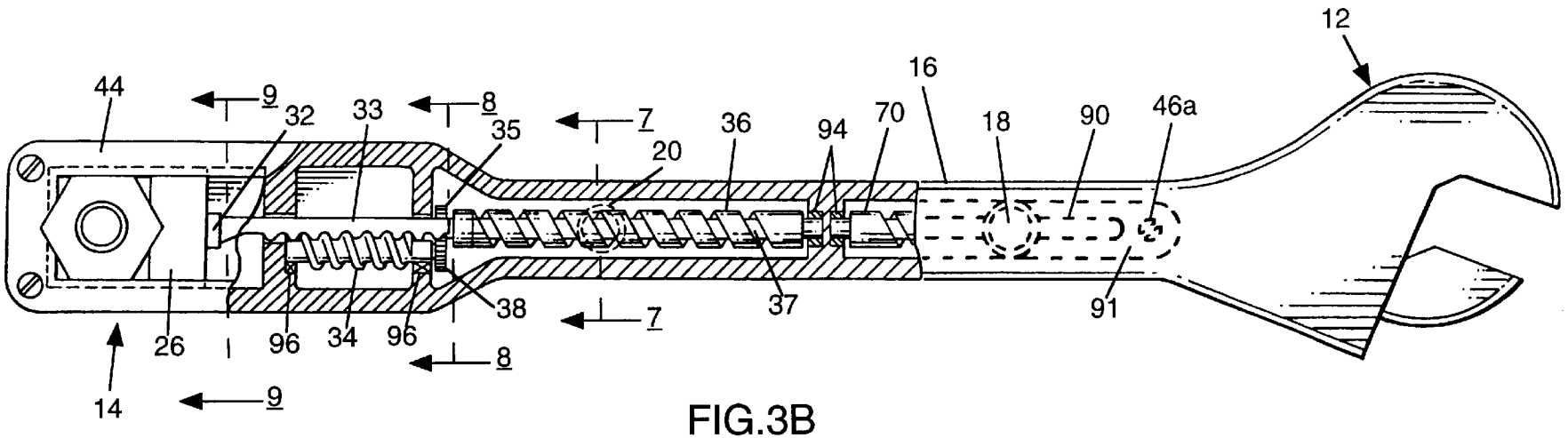
FIG. 3*b* is a partly cutaway side elevation of the adjustable closed end wrench, detailing the operational mechanism of the wrench.
Figure 3C:
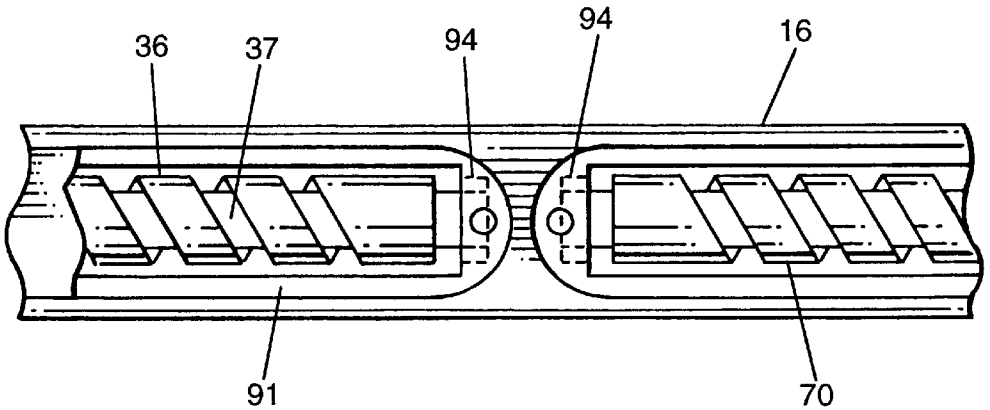
FIG. 3*c* is a partly cutaway side elevation of the double ended wrench, wherein the helical grooved shafts to open and close respective wrench ends are off center, out of alignment, with each shaft located near a side of the wrench handle.
Figure 7:
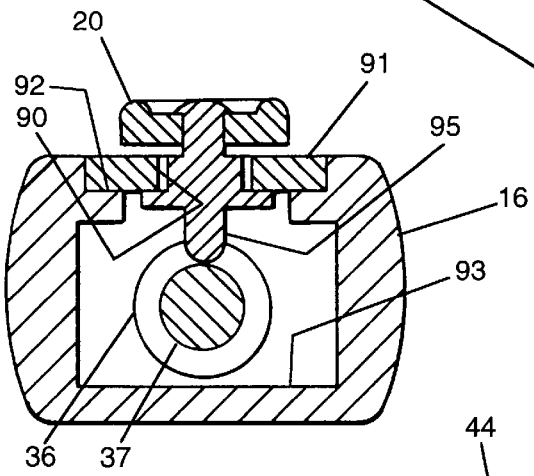
FIG. 7 is a transverse section taken along lines 7—7 of FIG. 3*b* detailing the construction of the moveable slide button assembly.

As is best seen in FIGS. 3*b* and 7, the rotation of helical shaft 36 is performed by means of a thumb button slider assembly 20, which is guided rectilinearly in a longitudinal keyway or slot 90 provided in cover plate 91. A shallow recess 92 receives the cover plate 91 surrounding the cavity 93 and is flush with the handle face found in elongated handle 16. The slide button assembly 20 includes a boss 95 at its extreme inner end, which is designed to be received by the spiral groove 37 found in helical shaft 36. End-bearing inserts 94, for stabilizing the helical shaft 36 are maintained securely in place by the retention of cover plate 91 with machine screws 46*a*. Such shafts can be can be located on either side of the handle, as shown in FIG. 3*c*, to open and close respective wrench ends. More preferably, the individual helical geared shafts 36,70*a* are in axial alignment as shown in FIG. 3*b*.

Figure 8A:
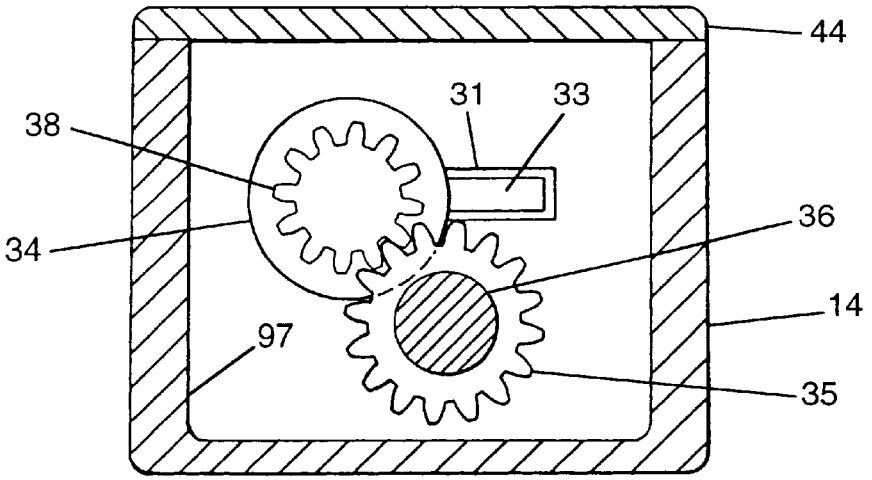
FIG. 8*a* is a transverse section taken along lines 8—8 of FIG. 3*b* showing the gear drive arrangement and the rectangular opening for guiding the moveable rack gear; and the diameter of the helical shaft drive gear is smaller than the diameter of the worm drive gear.

FIGS. 3*b* and 8*a* best illustrate the gearing arrangement means to operate the opening and closing of the moveable jaw 26 of the closed end wrench 14. The closed end wrench cavity 97 houses helical drive gear 35 and driven worm drive gear 38 and is protected by jaw cover plate 44. Gear 35 is found located securely attached at the far end of helical shaft 36. It in turn operates worm drive gear 38 that is securely attached to worm gear or pinion 34. End-bearing blocks 96 guide and maintain the positioning of worm gear 34 and are held in place by the jaw cover plate 44. Rack gear 33 is guided through the rectangular shaped hole 31 to maintain its alignment while being engaged by worm gear 34. The rack gear or rack 33 and worm gear or pinion 34 are essentially parallel to the spiral grooved shaft 36.

The diameter of helical drive gear 35 is preferably smaller than the diameter of the driven worm drive gear 38. As such the force applied by manual actuation of the second slide button is incremented by the gear ratio to maximize the force on the worm drive gear 38, pinion 34 and its rack 33, and ultimately, on the movable jaw 26 of the closed box. This wrench is a linear, high torque system for application of maximum torque, while the potential for stripping the hex nut is diminished by the maximum contact area with a hex nut that the wrench provides.

Figure 8B:
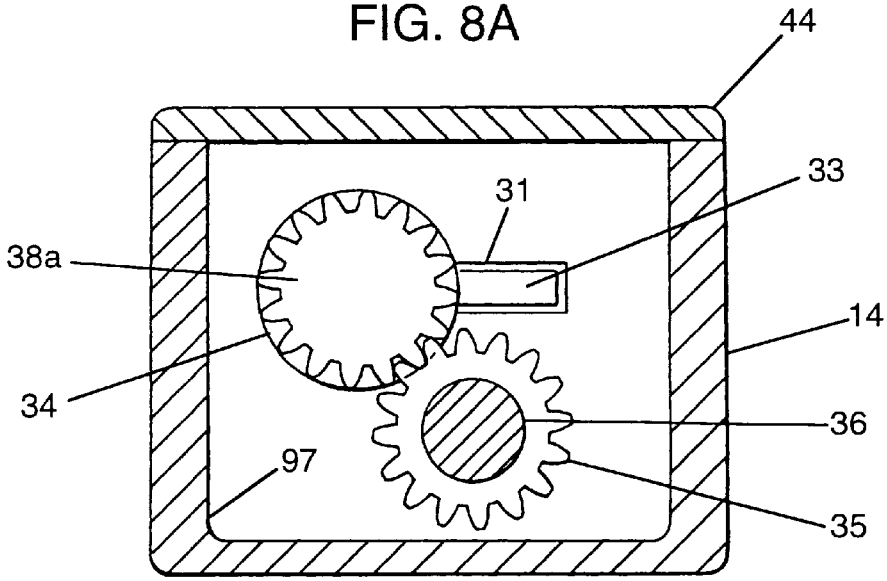
FIG. 8*b* is a transverse section taken along lines 8—8 of FIG. 3*b* showing the gear drive arrangement and the rectangular opening for guiding the moveable rack gear, wherein the diameter of the helical shaft drive gear is the same as the diameter of the worm drive gear.
Figure 8C:
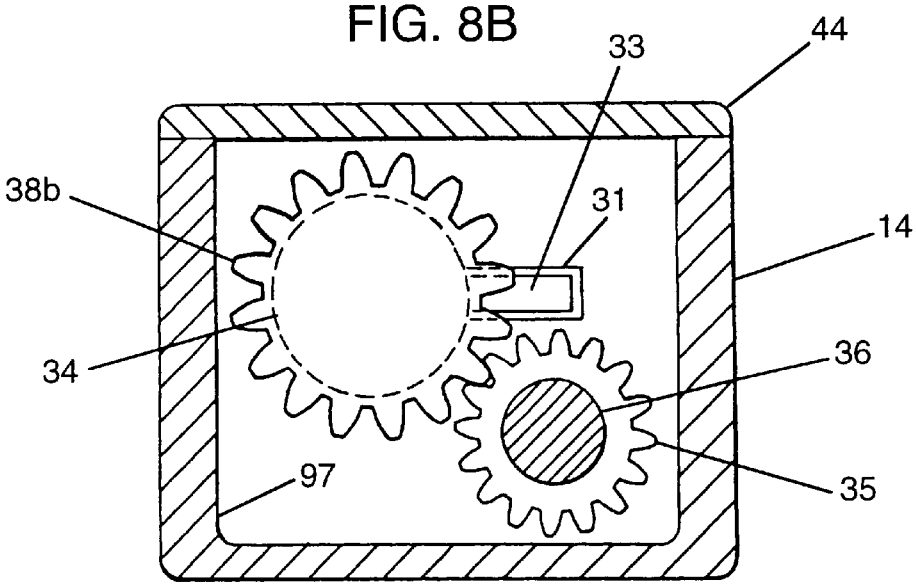
FIG. 8*c* is a transverse section taken along lines 8—8 of FIG. 3*b* showing the gear drive arrangement and the rectangular opening for guiding the moveable rack gear; and the diameter of the helical shaft drive gear is larger than the diameter of the worm drive gear.

The alternatives would be a wrench design with a helical drive gear 35 that is the same diameter, FIG. 8*b*, which would provide no gear ratio or advantage; or slightly larger than the worm drive gear 38, shown in FIG. 8*c*, that would result in exaggerated movement of the movable jaw 26 with just minimal movement of the second slide button 20. However, that design would not further the goal of applying maximum torque to the workpiece.

Figure 9:
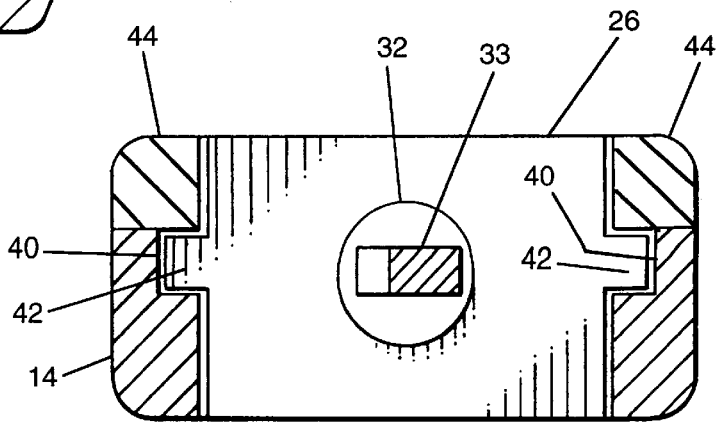
FIG. 9 is a transverse sectional view taken along lines 9—9 of FIG. 3*b* illustrating the moveable jaw mounting and the rack gear attachment means.

With reference to FIGS. 3*b*, 4 and 9, illustrated is a transverse sectional view of the moveable jaw 26 in relationship to the fixed body 14*a* of the closed end wrench 14. The moveable jaw 26 is retained by captivating the compression bearing 32 to the moveable rack gear 33, thereby allowing the rack gear to be driven by the rotation of worm gear 34. Full travel motion of the moveable jaw 26 is accomplished by guiding it in the rectangular channel or slot 40 found in the body 14*a* of closed end wrench 14. Rectangular tracks 42 guide the moveable jaw 26 as it travels in the rectangular channel or slot 40. The pair of tracks 42 that project from the movable jaw 26 preferably have a T-shape for insertion into the slots formed by the wrench body 14*a* and the jaw cover plate 44. The T-shaped tracks 42 provide an interlock for stability of the movable jaw 26 when stressed by torque exerted on the closed box wrench. The jaw cover plate 44 is secured in place with two machine screws 46 and the interlocking beveled edges 48, (FIG. 4).

Figure 5:
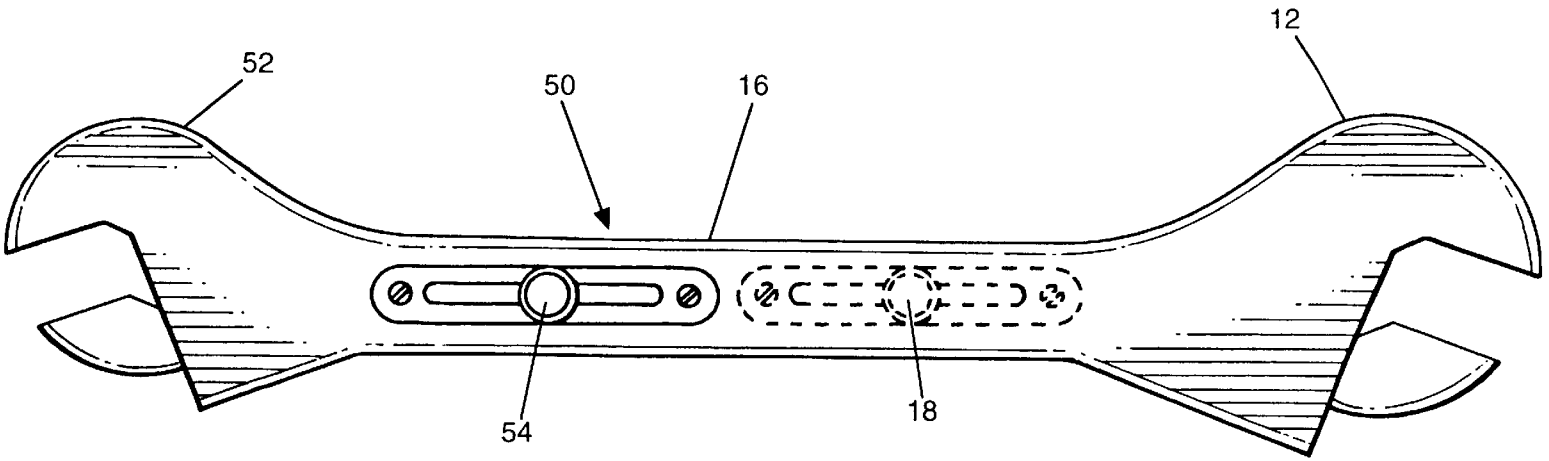
FIG. 5 is a side elevation of another alternative embodiment of the double ended wrench. Shown at each end of the double ended wrench are independently adjustable open end wrenches, where one wrench is sized smaller than the other.

In an alternative embodiment shown in FIG. 5, is a double open ended wrench 50, which is comprised of open ended wrench 12 and a reduced size open ended wrench 52. On either side of the elongated handle 16 are two independently actuated slide buttons 18 and 54 that provide a means of rotating the individual helical geared shafts that open and close each end of the wrench. Slide button 18 actuates a helical grooved gear which in turn opens and closes the jaw of open end wrench 12. Also, slide button 54 actuates another helical grooved gear which in turn opens and closes the jaw of open end wrench 52.

The dual sized open end wrenches 12 and 52 provide a convenient tool that allows the user to interchange the different sized ended as the occasion and need arises.

Shown in FIG. 6, is still another alternative embodiment of a double ended wrench. This embodiment is comprised of an open ended wrench 12 at one end and a ratchet driven socket wrench 62 at the other end. The drive shaft 66 is square in cross-section and is designed to receive a typical socket 64. To reverse the direction of the internal ratchet, lever 68 is rotated to its alternate position.

Those skilled in the art will recognize that other substitutions in materials or alterations in dimensions can be made without departing from the spirit of the invention defined in the claims.

What is claimed is:

1. A gear operated, individually adjustable double ended wrench having a handgrip with two sides, first and second ends and a grip channel; a first work engaging means at the first handgrip end, a first adjustment means in the handgrip associated with the first work engaging means, and a first drive means for independent adjustment of the first work engaging means; a closed box wrench at the second handgrip end comprising a fixed jaw and a movable jaw that can be repositioned in opposition to the fixed jaw; the closed box wrench further comprising a pair of rectangular slots formed between the second handgrip end and a jaw cover plate, a corresponding pair of tracks projecting from the moveable jaw, each of the pair of tracks received by the corresponding pair of slots for guiding the moveable jaw when opening or closing the closed box wrench; a second adjustment means in the handgrip for the closed box wrench and independent adjustment thereof by a rectilinear manual motion of the second adjustment means along the handgrip; a second drive means for independent adjustment of the closed box wrench, comprising the grip channel having a helical grooved shaft retained in longitudinal, rotatable position in the channel on a plurality of end bearing inserts held in place by a grip cover plate; the second adjustment means articulating with grooved shaft; a drive gear connected to the grooved shaft near a forward end thereof, said drive gear engaging a worm drive gear; a rotatable worm pinion connected forward of the worm drive gear essentially parallel with the shaft; the worm pinion positioned on a plurality of end bearing blocks retained by the jaw cover plate over a closed box cavity, the pinion having an associated rack in a rectangular shaped hole to maintain a rack alignment in said cavity; the rack, essentially parallel to the shaft, interconnected with the movable jaw through a compression load bearing, whereby linear action on the second adjustment means rotates the helical geared shaft, the drive gear, worm drive gear and worm pinion, for linear movement of the rack and consequent movement of said bearing and movable jaw in relation to the fixed jaw for opening or closing of the closed box wrench.

2. The gear operated wrench of claim 1, wherein each of the pair of tracks is formed as a T-shaped interlock for stability of the movable jaw when stressed by torque exerted on the closed box wrench.

3. The gear operated wrench of claim 2, the handgrip having a handle face that includes a shallow recess to receive the grip cover plate, whereby the grip cover plate is installed flush with the handle face.

4. The gear operated wrench of claim 3, the grip cover plate having a longitudinal keyway therethrough; and, wherein the second adjustment means comprises a second slide button having a boss that articulates with the grooved shaft through the longitudinal keyway for rotation of the shaft by linear movement of the second slide button.

5. The gear operated wrench of claim 4, wherein the first adjustment means comprises a first slide button for linear actuation and control of the first work engaging means; wherein the first work engaging means comprises a canted open box wrench at the first handgrip end comprising a fixed jaw and an adjustable opposing jaw that can be repositioned essentially parallel to the fixed jaw; wherein the drive means for independent adjustment of the open box wrench comprises the first slide button engaging a spiral grooved shaft with first and second ends rotatably installed in the handgrip on a plurality of end bearings, and the second shaft end having a rigidly attached beveled pinion, articulating with a beveled pinion gear of a worm gear assembly that is stabilized in the first handgrip end by an annular nut; the worm gear assembly further comprises a rack joined to the adjustable jaw of the open box wrench, such that rectilinear motion along the handgrip of the first slide button rotates the spiral grooved shaft, the beveled pinion, the beveled pinion gear, worm gear assembly and rack, for consequent movement of the adjustable jaw of the open box wrench, for opening and closing the canted open box wrench.

6. The gear operated wrench of claim 5, wherein the spiral grooved shaft and the helical grooved shaft are essentially parallel to one another, but not in coaxial alignment.

7. The gear operated wrench of claim 6, wherein the spiral grooved shaft and the helical grooved shaft are in coaxial alignment.

8. The gear operated wrench of claim 7, wherein the helical shaft drive gear and the worm drive gear each have a diameter; and, the diameter of the helical shaft drive gear is smaller than the diameter of the worm drive gear to maximize a force consequent to a manual operation of the second slide button on the worm drive gear, pinion and rack, and the movable jaw of the closed box.

9. The gear operated wrench of claim 8, wherein the first slide button and the second slide button are individually operable, for independent adjustment of the open box wrench the closed box wrench.

10. The gear operated wrench of claim 9, wherein the first slide button and the second slide button are positioned on opposite sides of the handgrip.

11. The gear operated wrench of claim 9, wherein the first slide button and the second slide button are positioned on the same handgrip side.

12. The gear operated wrench of claim 9, wherein the fixed jaw and the moveable jaw of the closed box wrench are both shaped to 120 degrees to define a closed box socket with the wrench body, whereby the closed box wrench clamps against all six sides of a hex shaped workpiece to reduce stripping of a hex nut.

13. The gear operated wrench of claim 7, wherein the helical shaft drive gear and the worm drive gear each have a diameter; and, the diameter of the helical shaft drive gear is larger than the diameter of the worm drive gear to maximize a movement of the movable jaw consequent to a manual actuation of the second slide button.

14. The gear operated wrench of claim 7, wherein the helical shaft drive gear and the worm drive gear each have a diameter; and, the diameter of the helical shaft drive gear is the same as the diameter of the worm drive gear.

15. An adjustable multi-function wrench according to claim 1, wherein the first adjustment means comprises a ratchet driven socket tool and the first work engaging means comprises a plurality of variously sized socket inserts, the tool designed to retain a socket insert of the plurality of inserts for adaptation of the first work engaging means to a workpiece.

16. An improved multi-function wrench according to claim 15, the ratchet driven socket tool further comprising a drive shaft.

17. An improved multi-function wrench according to claim 16, wherein the ratchet driven socket tool drive shaft is square in cross-section and adapted to receive a standard socket.

18. An improved multi-function wrench according to claim 16, further comprising a rotatable lever with first and second alternate rotative positions to reverse the direction of an internal ratchet concomitant with the rotative position selected.

* * * * *